US006474123B1

(12) United States Patent
Kito et al.

(10) Patent No.: US 6,474,123 B1
(45) Date of Patent: Nov. 5, 2002

(54) ELECTRONIC KEY DEVICE

(75) Inventors: Shozo Kito; Hiroyuki Sugiyama, both of Aichi; Masahiro Ishikawa, Toyota, all of (JP)

(73) Assignee: Kabushiki Kaisha Tokai Rika Denki Seisakusho (JP)

( * ) Notice: Subject to any disclaimer, the term of this patent is extended or adjusted under 35 U.S.C. 154(b) by 0 days.

(21) Appl. No.: 09/553,168

(22) Filed: Apr. 19, 2000

(30) Foreign Application Priority Data

May 11, 1999 (JP) ..... 11-130011

(51) Int. Cl.[7] ..... A47G 29/10

(52) U.S. Cl. ..... 70/456 R; 70/459; 206/37.2; 206/37.4; 429/97

(58) Field of Search ..... 70/257, 397, 398, 70/408, 456 R, 459, 454; 206/37.1, 37.2, 37.3, 37.5, 38.1; 429/97, 98; 362/116, 100

(56) References Cited

U.S. PATENT DOCUMENTS

| | | | | | |
|---|---|---|---|---|---|
| 1,972,880 | A | * | 9/1934 | Flintermann | |
| 2,618,736 | A | * | 11/1952 | Langhout | |
| 2,625,645 | A | * | 1/1953 | Crane | |
| 2,738,668 | A | * | 3/1956 | Rock | |
| 3,243,586 | A | * | 3/1966 | Fioravanti | |
| 3,377,475 | A | * | 4/1968 | Frigon | |
| 3,613,414 | A | * | 10/1971 | Ostrager | 70/456 R X |
| 3,973,422 | A | * | 8/1976 | Cervera | 70/456 R X |
| 4,888,970 | A | * | 12/1989 | Kinzler et al. | 70/456 R |
| 5,887,468 | A | * | 3/1999 | Hasan | 70/456 R |

FOREIGN PATENT DOCUMENTS

| | | | | |
|---|---|---|---|---|
| DE | 3902537 | * | 8/1990 | 70/456 R |
| EP | 0088699 | * | 9/1983 | 70/456 R |
| EP | 0117204 | * | 8/1984 | 70/456 R |
| FR | 2609304 | * | 7/1988 | 70/456 R |
| GB | 530249 | * | 12/1940 | 70/456 R |

* cited by examiner

*Primary Examiner*—Lloyd A. Gall
(74) *Attorney, Agent, or Firm*—Sawyer Law Group LLP

(57) ABSTRACT

An electronic key device has a housing, a substrate unit, a battery holder, a key passage, and a key. A lock pin provided on the battery holder is biased toward the key by a spring. A distal end of the pin enter the key passage for retaining or locking the key. When the key is not being used, the key is covered by the pin. When the key is being used, the pin advances into a locking aperture of the key to lock the key. The pin locks the battery holder to the housing. The use of one pin for locking the key and the battery against the housing enables miniaturization of the device.

21 Claims, 7 Drawing Sheets

ELECTRONIC KEY DEVICE

BACKGROUND OF THE INVENTION

The present invention relates to an electronic key device, and more particularly, to an electronic key device for automobiles.

In addition to higher performance and improved safety, convenience is important in automobiles. For example, a smart entry apparatus that uses an electronic key device has been proposed. With this apparatus, an automobile door is automatically unlocked when a person holding the electronic key device approaches the automobile. The door is locked automatically when the person holding the electronic key walks away from the automobile.

A typical smart entry apparatus is activated by an electronic key device. The electronic key device includes a housing that contains a battery holder, which holds a battery functioning as a power source, a substrate, to which integrated circuits are attached to achieve the necessary smart entry functions, and a key, which is used during abnormal states such as when the battery runs out of power. Further, the electronic key device includes a first locking member, which holds the key in a retracted position when the key is not in use, and a second locking member, which holds the key in an extended position, in which the key is ready for use.

When an abnormality occurs, such as when the battery runs out of power, the smart entry apparatus may not function properly. In such case, the key, which is normally retracted, is extended from the housing. Thus, the key may be inserted into a keyhole to lock or unlock the door. In this case, the first locking member releases and extends the key from the housing. The second locking member then functions to hold the key in the extended position.

In the prior art, the battery holder is removed from the housing to replace the battery. The battery holder is located in a cavity defined in the housing. The cavity is closed by a cap, which is always locked except when the battery is being replaced. A third locking member is provided to keep the cap locked.

In this structure, the first locking member is needed to hold the key in a locked position when the key is not in use, the second locking member is needed when the key is in a position to be used, and the third locking member is needed to keep the cap of the cavity closed. The locking members increase the number of required parts. This complicates the manufacture of the electronic key device and increases costs. Further, the three locking members occupy space and thus make miniaturization difficult.

SUMMARY OF THE INVENTION

It is an object of the invention to provide a compact electronic key device. It is another object of the present invention to provide an electronic key device that can be manufactured easily and inexpensively.

To achieve the foregoing and other objectives and in accordance with the purpose of the present invention, an electronic key device incorporating electronic components is provided. The device includes a housing, a battery holder for holding the battery, a key fitted in the key retainer, and a locking member. The housing has a cavity for containing a battery, which supplies power to the electronic components, and a key retainer. The battery holder is inserted into the cavity. The key is movable between a retracted position and an extended position. The battery holder is locked to and released from the housing by the locking member. The key is locked by the locking member when located in the extended position.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

Figure 2:
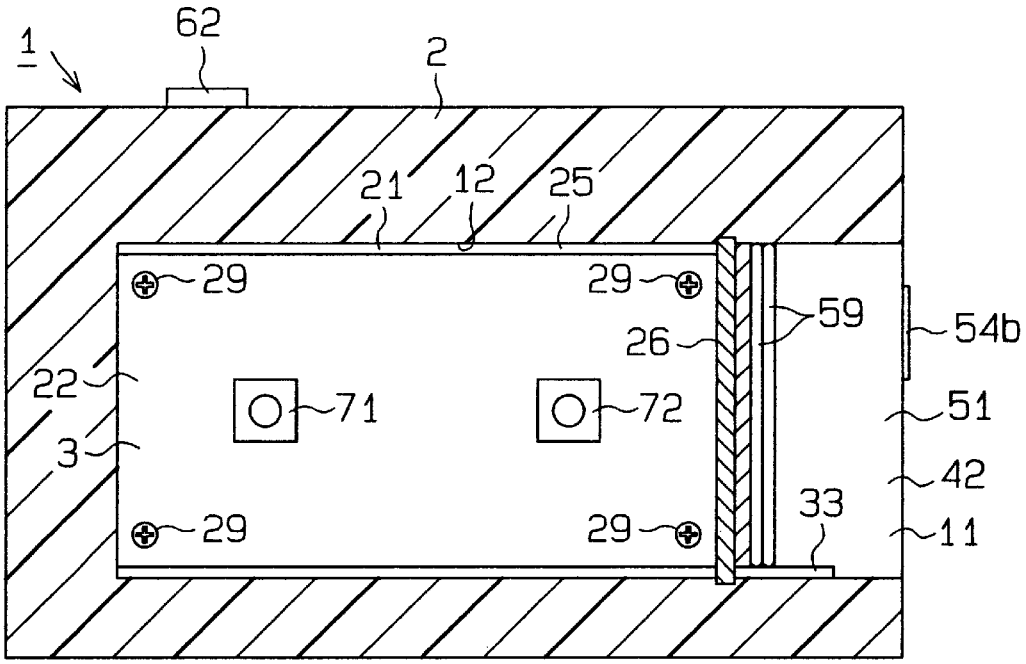
FIG. 2 is a cross-sectional view taken along line 2—2 in FIG. 1.
Figure 3:
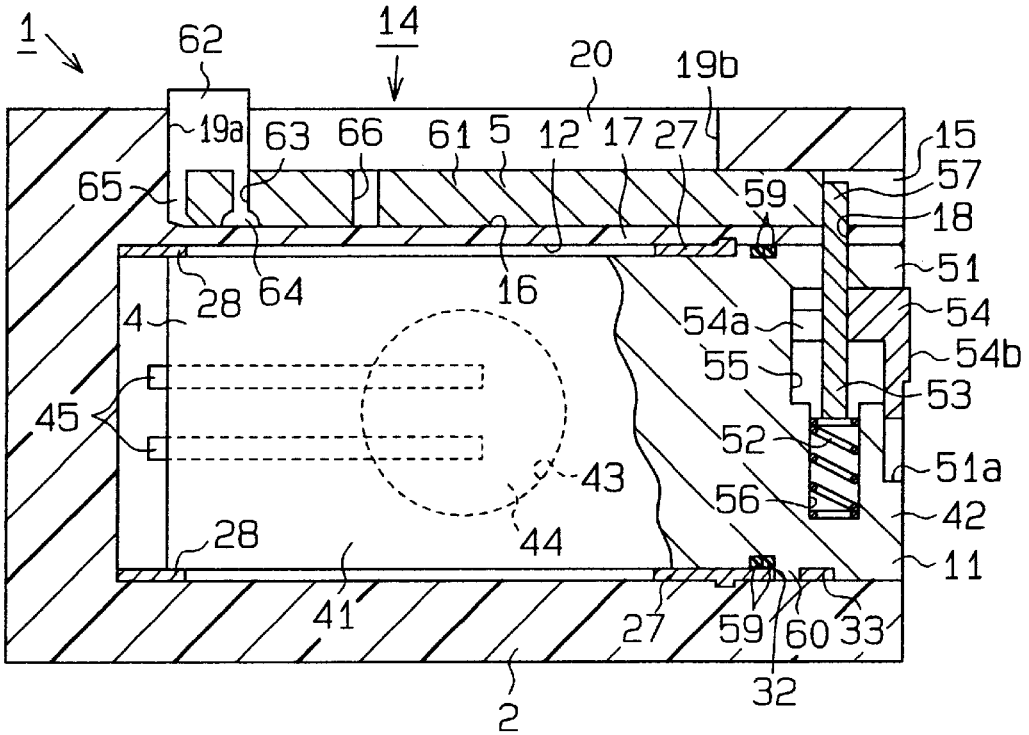
FIG. 3 is a cross-sectional view taken along line 3—3 in FIG. 1.
Figure 4:
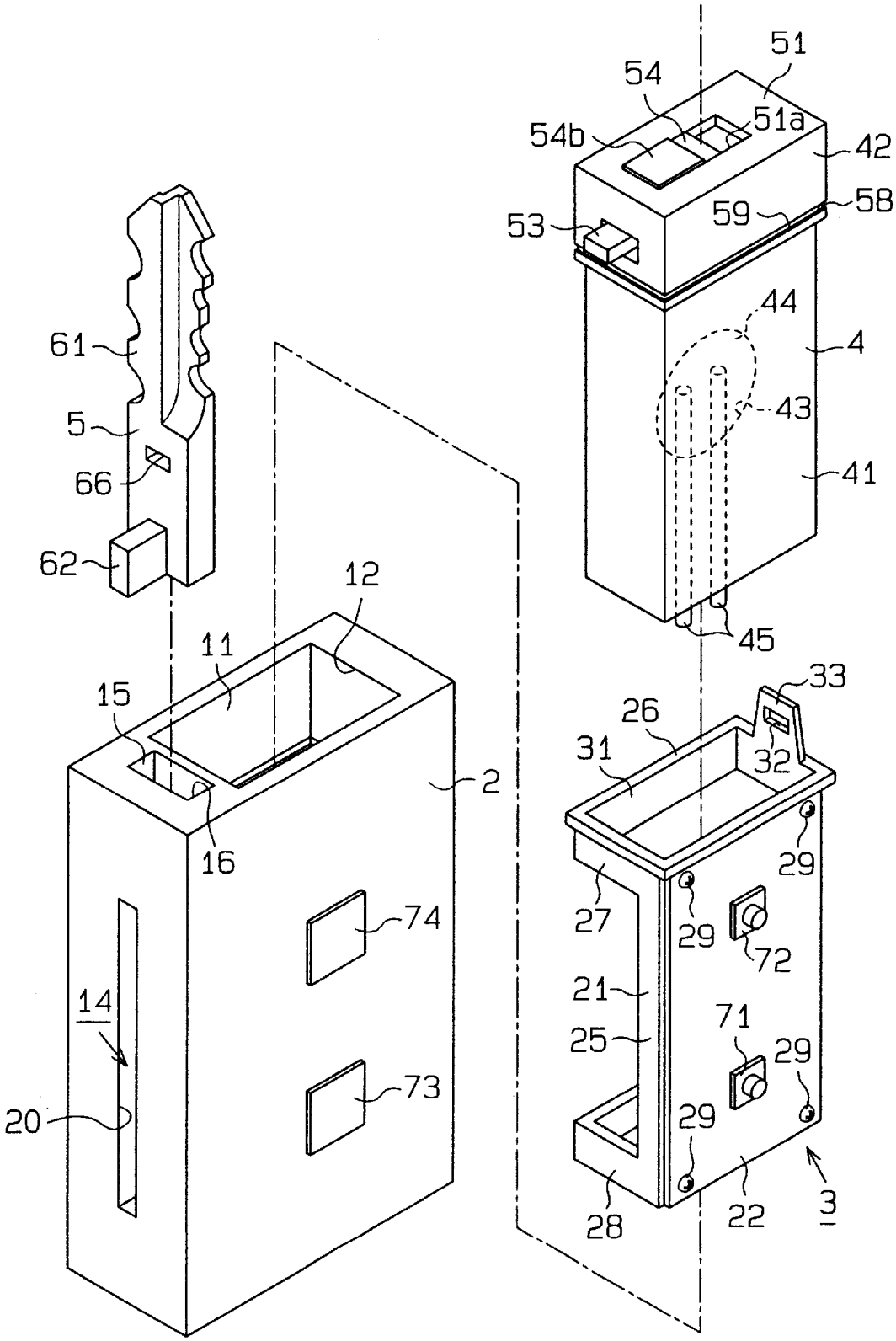
FIG. 4 is an exploded perspective view showing the electronic key device of FIG. 1.

An electronic key device for automobiles according to a first embodiment of the present invention will now be described with reference to the drawings. With reference to FIGS. 2 to 4, the electronic key device 1 includes a housing 2, a substrate unit 3, a battery holder 4, and a key 5. The housing 2 is made of a rigid synthetic resin, such as polybutylene terephthalate. Further, the housing 2 is box-like and has a relatively large, rectangular front opening 11, which is defined on the front end (the right end as viewed in FIGS. 2 and 3) of the housing 2. A cavity 12, which accommodates a battery 44, extends from the large opening 11 to the rear end (the left end as viewed in FIGS. 2 and 3) of the housing 2. The substrate unit 3 is arranged in the cavity 12.

With reference to FIG. 4, the substrate unit 3 includes a substrate holder 21 and a substrate 22, on which electronic components are attached. The electronic components include integrated circuits. The substrate holder 21 has a base 25, a receptacle 26, a first frame 27, and a second frame 28. The first and second frames 27, 28 are rectangular and arranged on opposite ends of the base 25. The substrate 22 is fastened to the base 25 by screws 29 (at four locations in this embodiment). The receptacle 26 is located at the upper end of the substrate holder 21, as viewed in FIG. 4, and defines a rectangular frame having a rectangular opening 31. A tab 33 projects from one side of the receptacle 26. A hole 32 extends through the tab 33.

Figure 5:
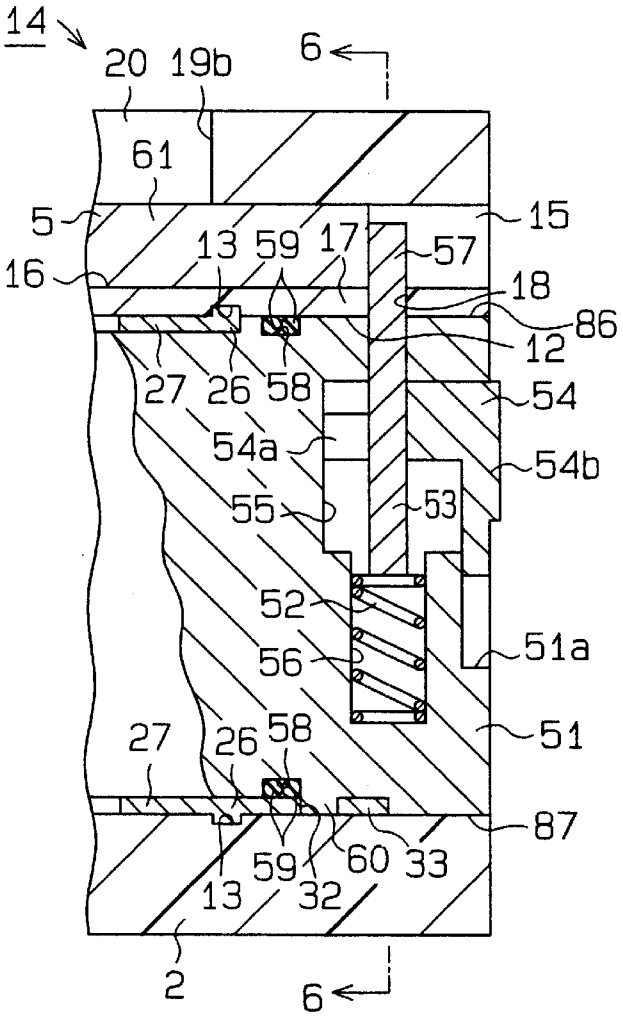
FIG. 5 is a partial cross-sectional view showing the electronic key device of FIG. 1.

As shown in FIG. 5, the substrate holder 21 is fixed in the housing 2 by the engagement of the edges of the receptacle 26 with a groove 13, which extends along the wall of the cavity 12. A battery holder 4 fits into the first and second frames 27, 28.

The battery holder 4 includes a box-like case 41, which houses the battery 44, and a cap 42. The cap 42 can be attached to and detached from the case 41. The case 41 has a seat 43, which receives the battery 44. Terminals 45 are arranged in the case 41 to supply the substrate 22 with power from the battery 44.

As shown in FIG. 5, the cap 42 includes a cap body 51, a spring 52, a lock pin 53, and a lever 54. The cap body 51 has a hollow portion 55, a first side surface 86, and a second side surface 87. A spring bore 56 extends from the hollow portion 55 to a location near the second side surface 87 to retain a spring 52. The diameter of the spring bore 56 is smaller than the corresponding dimension of the hollow portion 55.

Figure 6:
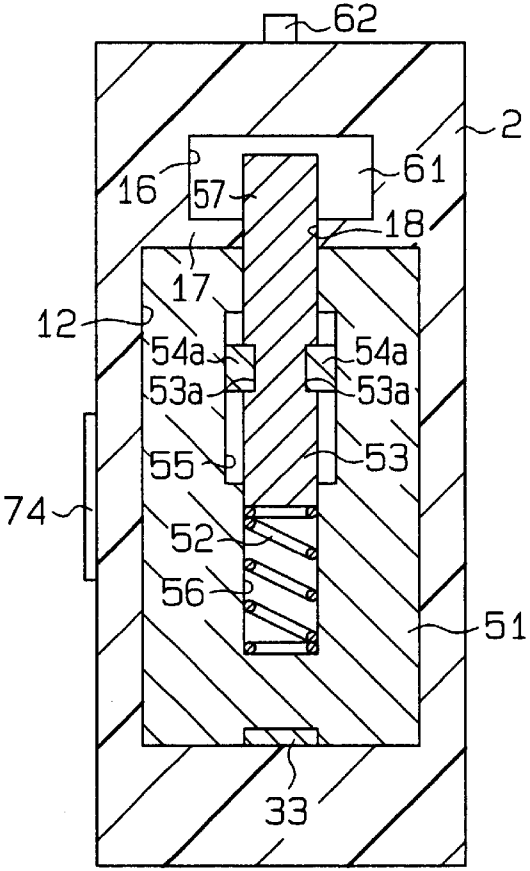
FIG. 6 is a cross-sectional view taken along line 6—6 in FIG. 5.

The pin 53 is plate-like and functions as a locking member. The proximal end of the pin 53 is urged toward the key 5 by the spring 52. The distal end 57 of the pin 53 normally extends from a first side surface 86 of the cap body 51. As shown in FIG. 6, a pair of opposing notches 53*a* are formed at the middle section of the pin 53. A pair of plates 54*a*, which extend from the lever 54, are received in the notches 53*a*. The lever 54 has a raised portion 54*b* located on one end. The raised portion 54*b* makes the lever 54 easy to manipulate. An elongated hole 51*a* extends through the distal surface of the cap body 51 parallel to the pin 53. The lever 54 is exposed from the elongated hole 51*a* so that the raised portion 54*b* can be manipulated.

Referring to FIGS. 4 and 5, a groove 58 extends along the outer surface of the cap body 51 near the case 41. Two O-rings 59 are received in the groove 58 to protect the battery 44 from moisture. A projection 60 extends from the second side surface 87 of the cap body 51. The projection 60 fits into the hole 32 of the tab 33.

With reference to FIGS. 3 and 4, a key retainer 14 is located at one end of the housing 2. The key retainer 14 includes an elongated passage 16 and a slot 20 connected with the passage 16. The slot 20 extends through one of the side surfaces of the housing 2. The passage 16 has a small front opening 15, from which the passage 16 extends toward the rear end of the housing 2. The small opening 15 is rectangular and is located on the same surface of the housing 2 as the large opening 11. The key 5 projects from the small opening 15. A partition 17 is located between the cavity 12 and the passage 16. A hole 18 extends through the partition 17 at a position corresponding to the pin 53 and connects the cavity 12 to the passage 16.

The distal end 57 of the pin 53 fits into the hole 18 and can be extended into and retracted from the hole 18. The pin 53 is urged by the spring 52 and is normally held at a position in the passage 16 that is determined when the lever 54 contacts the wall defining one end (the upper end as viewed in FIG. 3) of the elongated hole 51*a*. The insertion of the distal end 57 of the pin 53 into the hole 18, the engagement of the projection 60 with the hole 32, and the fastening of the substrate holder 21 to the housing 2 prevent the battery holder 4 from falling out of the substrate holder 21 and the housing 2. In other words, the pin 53 functions as a mechanism for locking the battery holder 4 to the housing 2.

The key 5, which is retained in the passage 16, includes a key plate 61 and a block 62. The key plate 61 has a hole 63 located at its proximal end (FIG. 3). The block 62 includes a fitting piece 64, which is press fitted into the hole 63, and an engaging piece 65, which is engaged with the proximal end of the key plate 61. Thus, the block 62 is integrally fixed to the key plate 61. The key plate 61 further has a locking aperture 66 located at a position spaced from the hole 63.

The slot 20 extends along the side surface of the housing 2 in the longitudinal direction (the horizontal direction as viewed in FIG. 3) of the key plate 61. The block 62 extends into the slot 20 and moves between the front and rear ends of the housing 2. The slot 20 extends between a rear engaging surface 19*a*, which engages the block 62 when the key 5 is not in use, and a front engaging surface 19*b*, which engages the block 62 when the key 5 is in use. The front and rear engaging surfaces 19*a*, 19*b* restrict the movement of the block 62. The distal end of the block 62 extends from the side surface (the upper surface as viewed in FIG. 3) of the housing 2 through the slot 20.

When the key 5 is not in use, the key 5 is located in a retracted position, as shown in FIG. 3. In this state, the block 62 engages the rear engaging surface 19*a* of the housing 2, and the distal end of the key plate 61 engages the pin 53. Accordingly, the entire key plate 61 is retained in the passage 16.

When the key 5 is located at the retracted position, the pin 53 serves as a mechanism that retains the key plate 61 in the housing 2. As mentioned above, the pin 53 also serves as a mechanism for locking the battery holder 4 to the housing 2.

Figure 8:
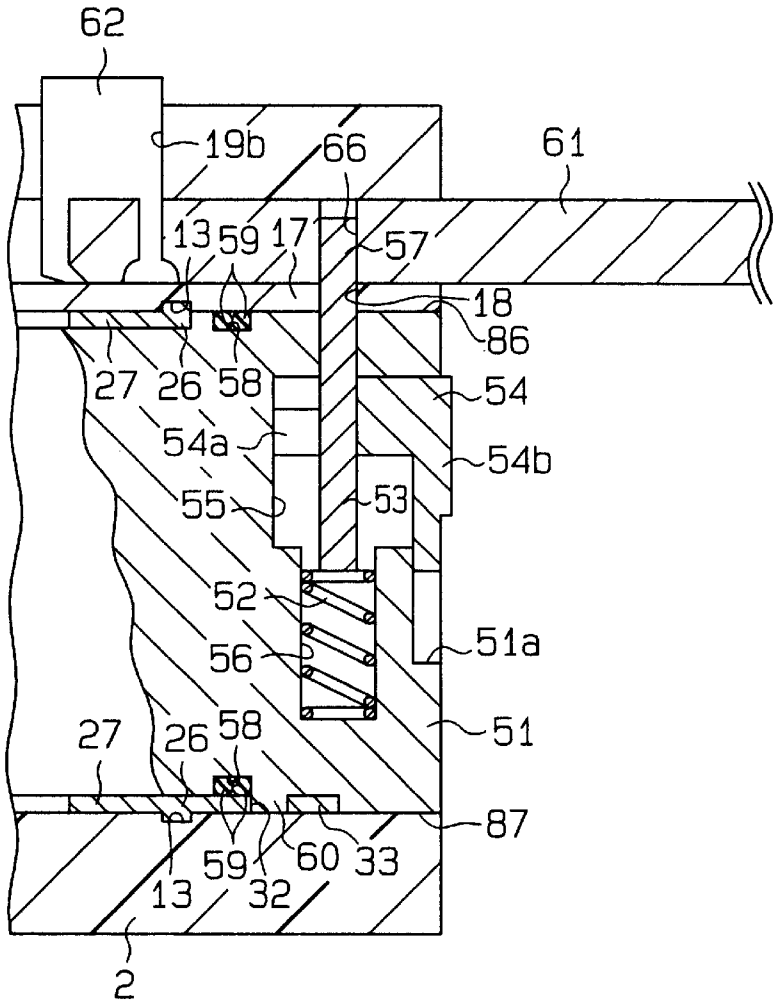
FIG. 8 is a partial cross-sectional view showing a key arranged at an extended position.

When the key 5 is in use, the key 5 is located in an extended position, as shown in FIG. 8. In this state, the block 62 is engaged with the front engaging surface 19*b* of the housing 2. The key plate 61 extends from the housing 2 such that it can be inserted into a keyhole of the automobile door. The distal end 57 of the pin 53 passes through the hole 18 and into the locking aperture 66 to hold the key 5 at a predetermined position. Accordingly, the distal end of the key plate 61 projects from the housing 2.

When the key 5 is located at the extended position, the pin 53 serves as a mechanism that locks the battery holder 4 to the housing 2 and as a mechanism that locks the key plate 61 at the predetermined position and prevents it from being pushed back into the passage 16.

Figure 7:
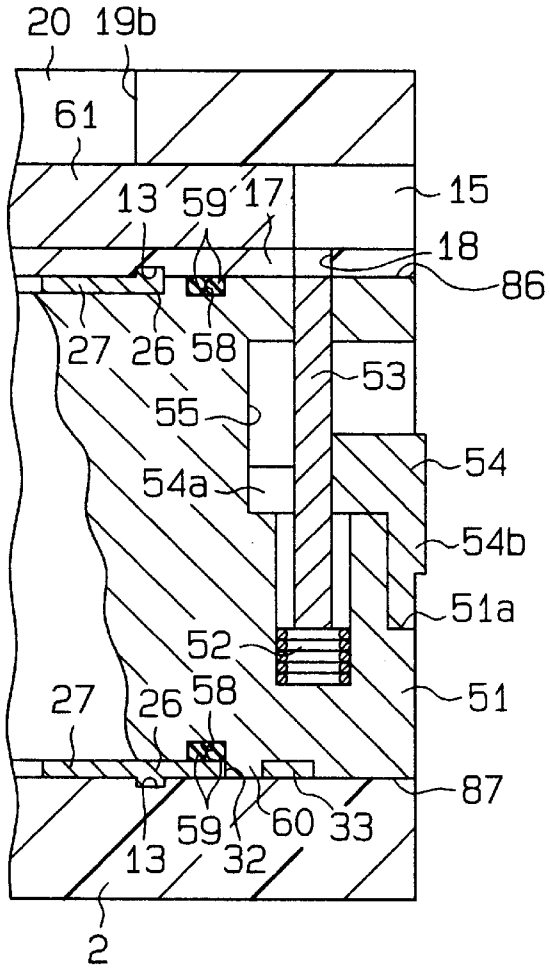
FIG. 7 is a partial cross-sectional view showing the electronic key device in a state in which projection of a key plate from the housing is permitted.

With reference to FIG. 7, to move the key 5 from the retracted position to the extended position, the lever 54 is moved away from the key 5 against the force of the spring 52 so that the pin 53 does not project from the first side surface 86 of the cap body 51. This allows the key plate 61 to be extended from the housing 2.

The key block 62 is then manually moved in the slot 20 toward the front end of the housing 2. The block 62 is moved until it engages the front engaging surface 19*b* of the housing 2, which stops the key 5 at the extended position. When the lever 54 of the battery holder 4 is released, the spring 52 forces the pin 53 toward the key 5. This causes the distal end 57 of the pin 53 to enter the hole 18 and the locking aperture 66, as shown in FIG. 8.

To return the key 5 to the retracted position from the extended position, the lever 54 is moved away from the key 5 against the force of the spring 52. This moves the distal end 57 of the pin 53 out of the locking aperture 66 to a position at which it does not project from the first side surface 86 of the cap body 51. As a result, the key plate 61 is released from the pin 53.

Then, the key block 62 is manually moved in the slot 20 toward the rear end of the housing 2. The block 62 is moved until it engages the rear engaging surface 19*a* of the housing 2, which stops the key 5 at the retracted position. When the lever 54 of the battery holder 4 is released, the spring 52 forces the pin 53 toward the key 5. The distal end 57 of the pin 53 enters the hole 18 and the passage 16. This engages the distal end of the key plate 61 with the pin 53.

To replace the battery 44 of the battery holder 4, the lever 54 is moved away from the key 5 against the force of the spring 52. This moves the pin 53 to a position at which it does not project from the first side surface 86 of the cap body 51. The projection 60 of the cap body 51 is then disengaged from the hole 32 of the tab 33, which extends from the substrate holder 21, against its own elasticity.

After replacing the battery 44, the battery holder 4 is placed in the housing 2. This is done by first moving the lever 54 against the force of the spring 52 to a position at which the pin 53 does not project from the first side surface 86 of the cap body 51. The battery holder 4 is then inserted through the large opening 11 until the projection 60 deforms against its elasticity and fits into the hole 32 of the tab 33. When the lever 54 is released, the spring 52 moves the pin 53 toward the key 5. This causes the distal end 57 of the pin 53 to enter the hole 18 and the passage 16.

Figure 1:
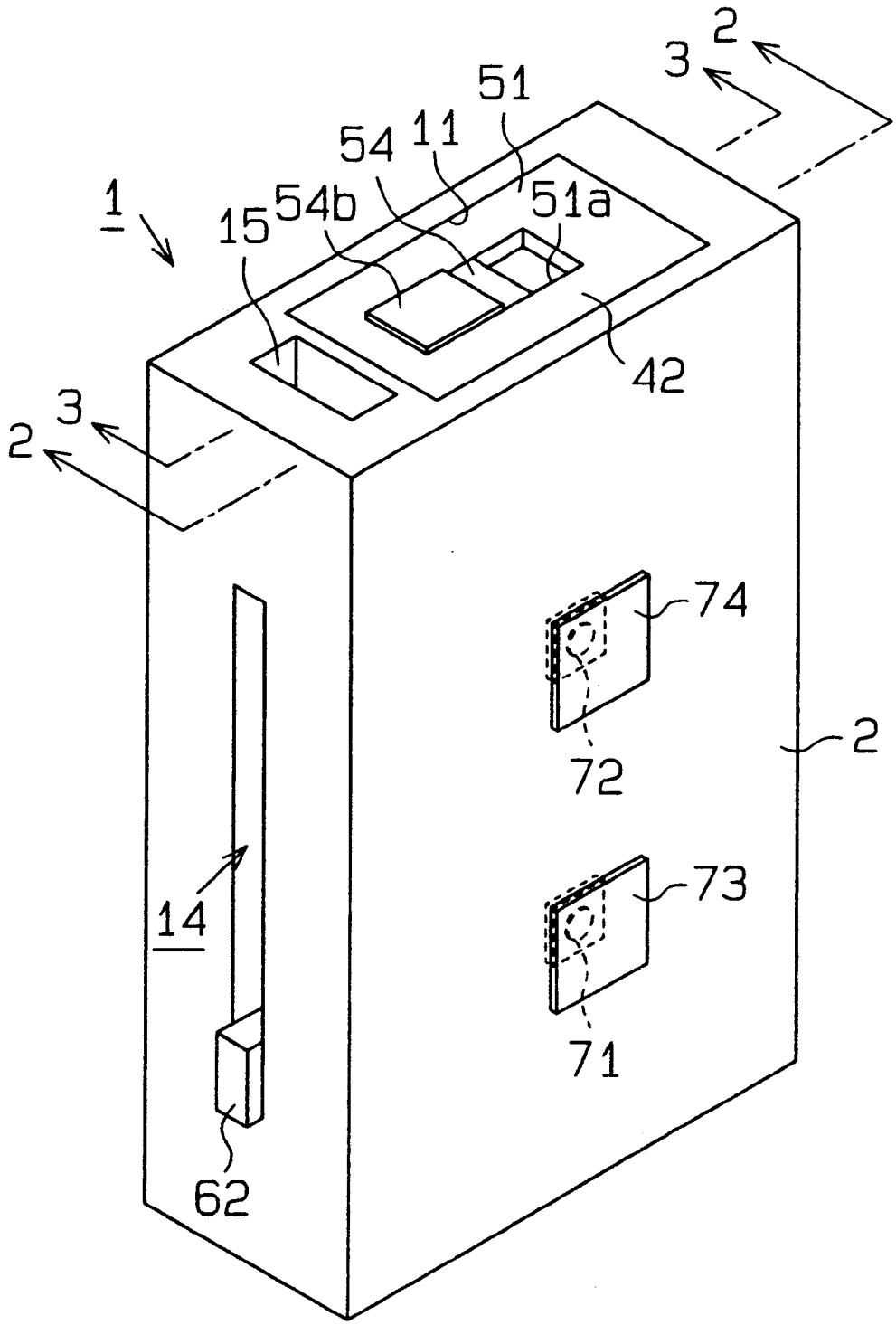
FIG. 1 is a perspective view showing an electronic key device according to a first embodiment of the present invention.

As shown in FIG. 2, various switches 71, 72 and various types of integrated circuits (not shown) are arranged on the substrate 22. The integrated circuits include circuits that achieve the smart entry functions. The switches 71, 72 are used to open the trunk without using the key 5 or to turn the interior lamps of the automobile on and off. Buttons 73, 74 on the housing 2 (FIG. 1) are pushed to activate the switches 71, 72, respectively. This opens the trunk without using the key 5 and turns the interior lamps of the automobile on and off.

The preferred and illustrated embodiment has the advantages described below.

When the key 5 is located at the retracted position, the pin 53 engages the distal end of the key plate 61 to lock the key 5 in place. When the key 5 is located at the extended position, the distal end 57 of the pin 53 is fitted in the locking aperture 66 of the key plate 61 to lock the key 5 in place. Further, the distal end 57 of the pin 53 is inserted through the hole 18 of the partition 17 to lock the battery holder 4 in the housing 2. Accordingly, the same component (pin 53 ) is used to lock the key 5 at the retracted and extended positions and to lock the battery holder 4 to the housing 2. This allows the electronic key device 1 to be smaller.

The pin 53 is moved toward the key 5 by the force of the spring 52. This locks the key 5 when in use, locks the key 5 when not in use, and locks the battery holder 4.

When using the key 5, the key 5 extends from the housing 2 through the small opening 15, which is located on the same surface of the housing 2 as the large opening 11.

When the key 5 is not in use, the pin 53 locks the key 5 while functioning to cover the passage 16.

It should be apparent to those skilled in the art that the present invention may be embodied in many other specific forms without departing from the spirit or scope of the invention. Particularly, it should be understood that the present invention may be embodied in the following forms.

Figure 9:
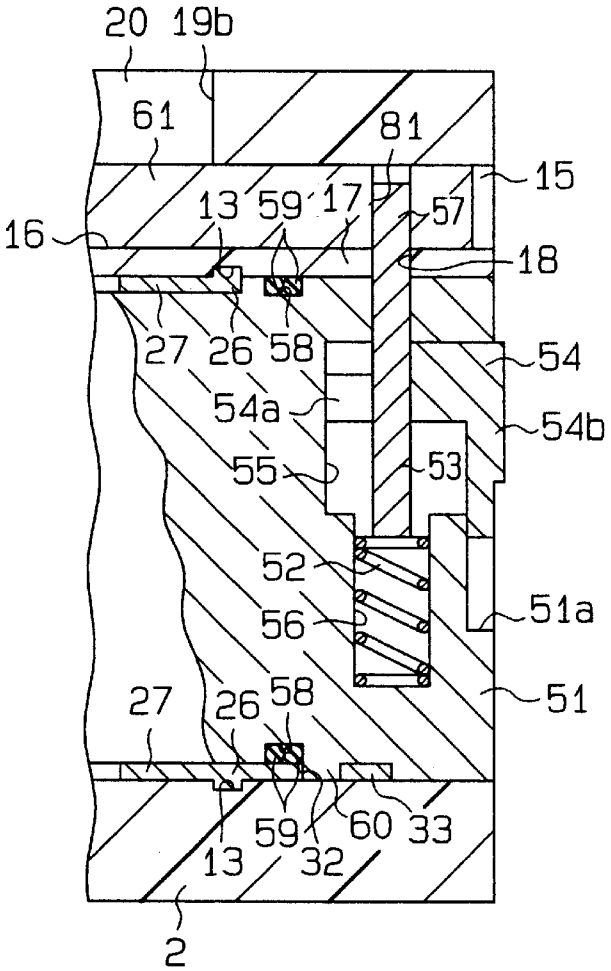
FIG. 9 is a partial cross-sectional view showing an electronic key device according to a further embodiment of the present invention.

As shown in FIG. 9, a locking aperture 81 may be provided in the distal end of the key plate 61 to receive the distal end 57 of the pin 53 when the key 5 is located at the retracted position. This locks the key 5 at the retracted position.

Figure 10:
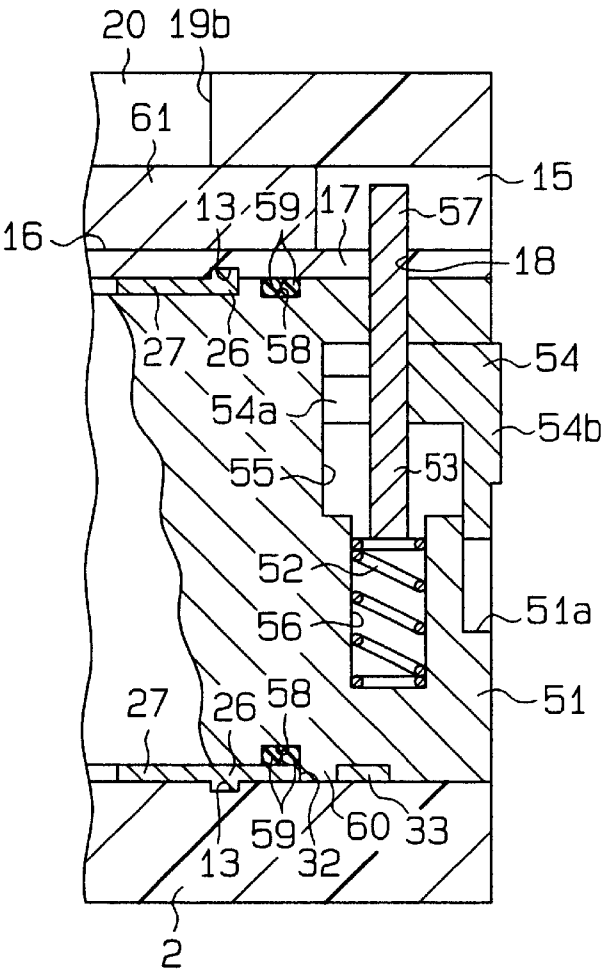
FIG. 10 is a partial cross-sectional view showing an electronic key device according to a further embodiment of the present invention.

As shown in FIG. 10, the distal end of the key plate 61 may be separated from the pin 53 when the key 5 is located at the retracted position. Although the key 5 moves slightly in the longitudinal direction, the key plate 61 is restricted within the housing 2 and does not project from the housing 2.

A device for pushing the key 5 out of the housing 2, such as a compression spring (not shown) may be provided. To move the key 5 from the retracted position to the extended position, the key 5 is released from the pin 53 so that the pushing device can force the key 5 out of the housing 2. To move the key 5 from the extended position to the retracted position, the pin 53 is released from the key 5. The key 5 is then manually moved to the retracted position against the force of the pushing device. The pushing device moves the key 5 from the retracted position to the extended position without having to manually move the key block 62 in the slot 20.

Figure 11:
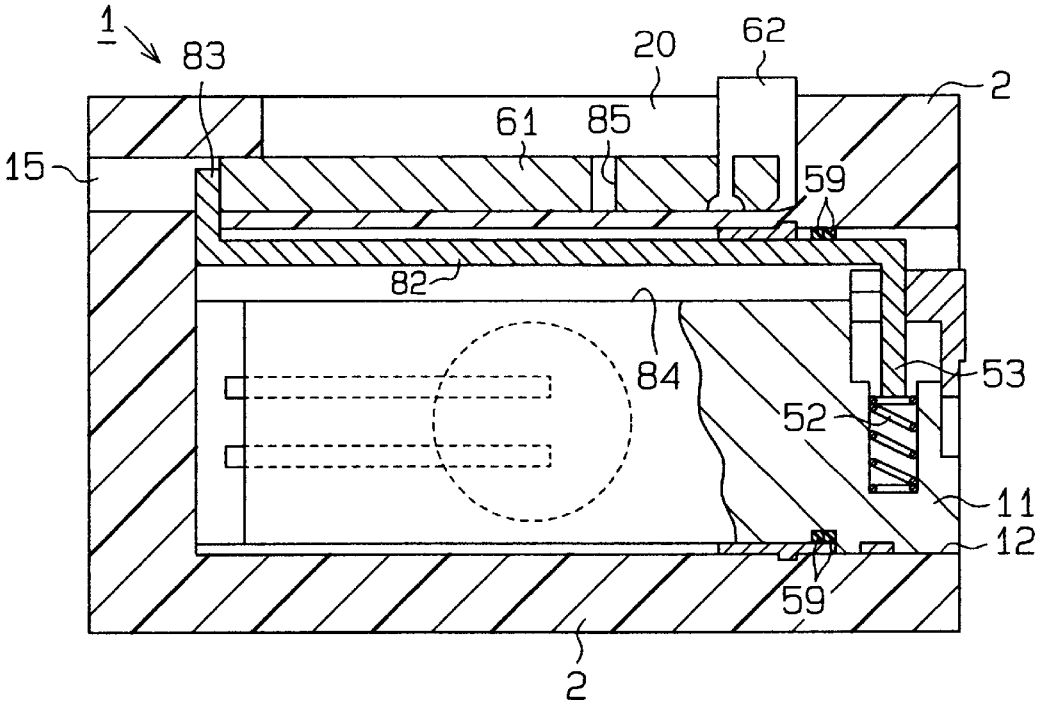
FIG. 11 is a partial cross-sectional view showing an electronic key device according to a further embodiment of the present invention.

The large and small openings 11, 15 may be arranged at opposite ends of the housing. For example, as shown in FIG. 11, an extension 82 may be formed to extend from the distal end of the pin 53 toward the opposite end of the housing 2. A plate 83 extends from the distal end of the extension 82 toward the key 5. The housing 2 has a space 84 that allows for movement of the extension 82. In the same manner as the first embodiment, a locking aperture 85 extends through the proximal end of the key plate 61.

When the key 5 is located at the retracted position, the spring 52 moves the plate 83 into the passage 16. The plate 83 functions to cover the passage 16 and locks the key 5 at the retracted position. To move the key 5 from the retracted position to the extended position, the key 5 is released from the plate 83. The key plate 61 is then extended from the small opening 15, which is opposite to the large opening 11. Accordingly, when the key 5 is in use, the key 5 projects from the small opening 15, which is located at the opposite end of the housing 2 from the lever 54.

The present examples and embodiments are to be considered as illustrative and not restrictive and the invention is not to be limited to the details given herein, but may be modified within the scope and equivalence of the appended claims.

What is claimed is:

1. An electronic key device incorporating electronic components, comprising:

a housing including a cavity for containing a battery, which supplies power to the electronic components, and a key retainer;

a battery holder for holding the battery, wherein the battery holder is inserted into the cavity;

a key fitted in the key retainer, wherein the key is movable between a retracted position and an extended position; and a locking member, wherein the battery holder is locked to and released from the housing by the locking member, wherein the key is locked by the locking member when located in the extended position, wherein the locking member is selectively moved into and out of the retainer, wherein the locking member is moved into the retainer when the key is locked, and wherein the key is released when the locking member is moved out of the retainer.

2. The device according to claim 1, wherein the locking member is provided on the battery holder to move with respect to the battery holder.

3. The device according to claim 1, wherein the cavity includes a battery opening, through which the battery holder is inserted into the cavity, and wherein the retainer includes a key opening, through which the key extends when the key is in the extended position, the battery opening and the key opening being located on the same side of the housing.

4. The device according to claim 1, wherein the cavity includes a battery opening, through which the battery holder is inserted into the cavity, and wherein the retainer includes a key opening, through which the key extends when the key is in the extended position, the battery opening and the key opening being located on opposite sides of the housing.

5. An electronic key device incorporating electronic components, comprising:

a housing, the housing including:

a cavity for containing a battery, which supplies power to the electronic components, wherein the cavity has a battery opening;

a key retainer, wherein the retainer has a key opening;

a battery holder for holding the battery, wherein the battery holder includes a cap and a case for containing the battery, the cap being detachable from the case, wherein the battery holder is inserted into the cavity through the battery opening;

a key fitted in the key retainer, wherein the key is movable between a retracted position and an extended position, wherein the key passes through the key opening when in the extended position such that the key is available for use; and a locking member provided on the cap of the battery holder, wherein the locking member moves with respect to the cap, wherein the battery holder is locked to and released from the housing by the locking member, and the key is locked in the extended position by the locking member.

6. The device according to claim 5 wherein a hole is formed to extend between the cavity and the retainer, and the locking member is selectively moved into and out of the hole and the locking member is moved into the hole to lock the key, and the key is released when the locking member is moved out of the hole.

7. The device according to claim 6, wherein the key opening and the battery opening are located on the same side of the housing.

8. The device according to claim 6, wherein the key opening and the battery opening are located on opposite sides of the housing.

9. The device according to claim 6, wherein a distal end of the locking member is selectively moved into and out of the hole, and the distal end engages the key to lock the key in the retracted position.

10. The device according to claim 6, wherein the key further includes a locking aperture, and the locking member fits into the locking aperture to lock the key in the retracted position.

11. The device according to claim 6, wherein the key further includes a locking aperture, and the locking member fits into the locking aperture to lock the key in the extended position.

12. The device according to claim 5, wherein the retainer further includes a slot, and the slot extends through a side of the housing and joins a key passage, which is located in the retainer, wherein the key includes a key plate and a block attached to the key plate, the block fits in the slot and protrudes from the housing, wherein the block is manipulated to move the key between the extended position and the retracted position.

13. An electronic key device incorporating electronic components comprising:

a housing including a cavity for containing a battery, which supplies power to the electronic components, and a key retainer;

a battery holder for holding the battery, wherein the battery holder includes a cap and a case for containing the battery, the cap being detachable from the case, wherein the battery holder is inserted into the cavity;

a key fitted in the key retainer, wherein the key is movable between a retracted position and an extended position;

a locking member provided on the cap of the battery holder, wherein the locking member moves with respect to the cap, wherein the battery holder is locked to and release d from the housing by the locking member, and the key is locked in the extended position by the locking member; and a substrate unit, wherein the electronic components are mounted on the substrate unit, the substrate unit being attached to the housing.

14. The device according to claim 13, wherein the locking member is selectively moved into and out of the retainer, wherein the locking member is moved into the retainer when the key is locked, and wherein the key is released when the locking member is moved out of the retainer.

15. The device according to claim 14, wherein the substrate unit includes a tab, and a hole is formed in the tab, wherein the battery holder includes a projection, and the projection of the battery holder fits into the hole of the substrate unit to attach the battery holder to the substrate unit.

16. The device according to claim 14, wherein the cavity includes a battery opening, through which the battery holder is inserted into the cavity, and wherein the retainer includes a key opening, through which the key extends when the key is in the extended position, the battery opening and the key opening being located on a same side of the housing.

17. The device according to claim 14, wherein the cavity includes a battery opening, through which the battery holder is inserted into the cavity, and wherein the retainer includes a key opening, through which the key extends when the key is in the extended position, the battery opening and the key opening being located on opposite sides of the housing.

18. The device according to claim 14, wherein the key further includes a locking aperture, and the locking member fits into the locking aperture to lock the key in the retracted position.

19. The device according to claim 14, wherein the key further includes a locking aperture, and the locking member fits into the locking aperture to lock the key in the extended position.

20. An electronic key device incorporating electronic components, comprising:

a housing including a cavity for containing a battery, which supplies power to the electronic components, and a key retainer;

a battery holder for holding the battery, wherein the battery holder is inserted into the cavity;

a key fitted in the key retainer, wherein the key is movable along the key retainer between a retracted position and an extended position; and a locking member, wherein the battery holder is locked to and released from the housing by the locking member, wherein the key is locked by the locking member when located in the extended position.

21. An electronic key device incorporating electronic components comprising:

a housing including a cavity for containing a battery, which supplies power to the electronic components, and a key retainer;

a battery holder for holding the battery, wherein the battery holder includes a cap and a case for containing the battery, the cap being detachable from the case, wherein the battery holder is inserted into the cavity;

a key fitted in the key retainer, wherein the key is movable between a retracted position and an extended position;

a locking member provided on the cap of the battery holder, wherein the locking member moves with respect to the cap, wherein the battery holder is locked to and released from the housing by the locking member, and the key is locked in the extended position by the locking member; wherein the locking member is selectively moved into and out of the retainer, wherein the locking member is moved into the retainer when the key is locked, and wherein the key is released when the locking member is moved out of the retainer; and a substrate unit, wherein the electronic components are mounted on the substrate unit, the substrate unit being attached to the housing.

* * * * *